US008106785B2

(12) United States Patent
Yokota

(10) Patent No.: US 8,106,785 B2
(45) Date of Patent: Jan. 31, 2012

(54) SMOKE DETECTOR

(75) Inventor: Hiroyuki Yokota, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 0 days.

(21) Appl. No.: 13/089,730

(22) Filed: Apr. 19, 2011

(65) Prior Publication Data

US 2011/0192479 A1 Aug. 11, 2011

Related U.S. Application Data

(62) Division of application No. 12/382,390, filed on Mar. 16, 2009.

(30) Foreign Application Priority Data

Mar. 21, 2008 (JP) ..... 2008-073492
Mar. 28, 2008 (JP) ..... 2008-085505
Mar. 31, 2008 (JP) ..... 2008-090580

(51) Int. Cl.
*G08B 17/10* (2006.01)

(52) U.S. Cl. ..... 340/628; 340/629; 340/630; 340/631; 340/632; 250/288; 250/339.02; 250/343; 73/23.31; 73/24.03; 73/28.01; 73/28.02; 73/28.03

(58) Field of Classification Search ..... 340/610, 340/628–632; 250/288, 339.12, 343; 73/23.31, 73/24.03, 28.01–28.04
See application file for complete search history.

(56) References Cited

U.S. PATENT DOCUMENTS

2004/0035184 A1* 2/2004 Yamano et al. ..... 73/28.01

FOREIGN PATENT DOCUMENTS

| | | |
|---|---|---|
| CN | 1485609 | 3/2004 |
| JP | 2000-509535 | 7/2000 |
| JP | 2004-78807 | 3/2004 |
| WO | 97/42486 | 11/1997 |

OTHER PUBLICATIONS

Partial European Search Report (in English language) issued Jul. 6, 2009 in European Patent Application No. 09 25 0784.

* cited by examiner

*Primary Examiner* — George Bugg
*Assistant Examiner* — Ojiako Nwugo
(74) *Attorney, Agent, or Firm* — Wenderoth, Lind & Ponack, LLP

(57) ABSTRACT

To enable an air velocity of sampling air to be precisely measured, a smoke detector (S) includes: a smoke detection part (22) connected to a sampling pipe (11); a fan (12) that sucks sampling air (SA) into the sampling pipe; and an air velocity sensor (15) that measures an air velocity of the sampling air within the sampling pipe. The air velocity sensor (15) is disposed at a primary side of the fan (12), and a straightening vane (25) is disposed between the air velocity sensor (15) and a suction port (12*a*) of the fan (12).

2 Claims, 7 Drawing Sheets

SMOKE DETECTOR

This application is a divisional application of application Ser. No. 12/382,390, filed Mar. 16, 2009.

BACKGROUND OF THE INVENTION

1. Field of the Invention

The present invention relates to a smoke detector that optically detects a contaminant such as smoke caused by fire and floating in the air, and detects the fire.

2. Description of the Related Art

A smoke detector is used for preventing fire or as a detecting system at a time of generation of the smoke or in a semiconductor manufacturing plant or a food factory requiring a certain level of environmental conservation.

The conventional smoke detector includes a smoke detection part connected to a sampling pipe, a fan that sucks sampling air into the sampling pipe, and a wind velocity sensor that measures a wind velocity of the sampling air within the sampling pipe (for example, refer to JP 3714926 B).

In the smoke detector, the sampling air flowing within the sampling pipe is partially introduced into the smoke detection part, and smoke detection is executed by a smoke sensor of the smoke detection part. After that, the sampling air is returned into the sampling air pipe. At this time, the fan is controlled on the basis of the air velocity measured by the air velocity sensor, and so controlled as to supply the sampling air as designed to the smoke detection part.

Further, the conventional smoke detector includes a smoke detection part having an inflow port and an outflow port, a sampling pipe disposed in a monitor space, an airflow pipe in which the sampling air flows, an intake side flow path branch part disposed in the airflow pipe and coupled to the inflow port of the smoke detection part, and a filter disposed between the inflow port and the intake side flow path branch part (for example, refer to JP 2000-509535 A).

In the smoke detector, a part of the sampling air flowing within the airflow pipe is introduced from an inlet of the intake side flow path branch part, and supplied to the smoke detection part after dust or the like are removed by the filter. Then, after smoke detection is executed by the smoke sensor of the smoke detection part, the sampling air is returned into the airflow pipe from the outflow port through an exhaust side flow path merging part.

As illustrated in FIG. 4, a fan 2 is incorporated into a sampling pipe 1, and an opening part 3 that sucks sampling air SA is defined at one end thereof.

When the fan (blower fan) 2 is used with a high air volume, an opening part 3*a* (sampling air intake) is opened large as indicated by a phantom chain line, and no disturbance of airflow which induces a reverse flow in a primary side pipe of the fan occurs in the vicinity of a suction port 4 of the fan 2.

However, when the opening part 3*a* is made smaller to reduce the suction air volume, the disturbance of airflow occurs within the primary side pipe of the fan due to rotation of rotor blades within the fan 2, and the reverse flow starts.

When the opening part 3*a* is further made as small as the opening part 3 indicated by a phantom solid line to further reduce the suction air volume, a reverse flow L circulates within the sampling pipe 1 due to the disturbance of air flow from the fan 2, and passes through an air velocity sensor 5. This makes the flow unstable in the vicinity of the air velocity sensor 5, and hence the air velocity cannot be precisely measured.

Therefore, in order to solve the above-mentioned problem, it is conceivable to sufficiently separate the air velocity sensor 5 apart from the fan 2 so as to avoid an influence of the reverse flow L, which is however not preferable since the smoke detector is upsized.

SUMMARY OF THE INVENTION

In view of the above-mentioned circumstance, a first object of the present invention is to enable the air velocity of the sampling air to be precisely measured.

Further, in the conventional example, a part of the sampling air containing dust or the like is directly introduced into the airflow pipe, and passes through the filter, and hence there is a case in which a large amount of dust or the like is deposited on the filter, or the filter is clogged with the dust. For that reason, the filter must be frequently cleaned or replaced, and hence it takes much time and expense to conduct maintenance work of the filter.

In view of the above-mentioned circumstance, a second object of the present invention is to reduce the amount of foreign matter such as dust which is sucked from an intake port of the intake side flow path branch part.

In the conventional smoke detection system, an inlet manifold is connected to the suction port of the fan. The fan sucks air into the inlet manifold through a pipe. Air from the outlet of the fan is exhausted directly to the atmosphere or to an exhaust pipe through an exhaust line except for a very small portion used for the purpose of sampling in the entire air flow that flows through the fan.

Then, a part of flow used for the purpose of sampling passes through the filter and enters the inlet of a detection chamber of the smoke detector. The outlet of the detection chamber is connected to the inlet manifold. However, the opening of the connection portion has been small, and the pressure loss of a flow at the branch part for sampling has been large.

In view of the above-mentioned circumstances, a third object of the present invention is to enable the pressure loss of the flow at the branch part having the smoke detection part to be reduced, and the sampling air flow exhausted from the smoke detection part and the sampling air flow in the airflow pipe which is sucked by the fan to be stably merged.

According to a first aspect of the present invention, a smoke detector includes: a smoke detection part connected to a sampling pipe; a fan that sucks sampling air into the sampling pipe; and an air velocity sensor that measures an air velocity of the sampling air within the sampling pipe, in which the air velocity sensor is disposed at a primary side of the fan, and a straightening vane is disposed between the air velocity sensor and a suction port of the fan.

According to a second aspect of the present invention, a smoke detector includes: a smoke detection part having an inflow port and an outflow port; a sampling pipe disposed in a monitor space; an airflow pipe coupled with the sampling pipe; and an intake side flow path branch part disposed in the airflow pipe and coupled with the inflow port of the smoke detection part, in which the intake side flow path branch part has an intake port directed opposite to a flow direction of sampling air flowing in the airflow pipe.

According to a third aspect of the present invention, a smoke detector includes: a smoke detection part having an inflow port and an outflow port; a sampling pipe disposed in a monitor space; an airflow pipe coupled with the sampling pipe, in which a fan intervenes; a flow path branch part coupled with an inflow port of the smoke detection part; and a flow path merging part disposed in the airflow pipe and coupled with the outflow port of the smoke detection part through an exhaust pipe, in which the flow path merging part is equipped with a nozzle part having an opening larger than the exhaust pipe, which sprays air toward a vent hole lower in pressure than the flow path branch part of the fan.

According to the present invention, the air velocity sensor is disposed at the primary side of the fan, and the straightening vane is disposed between the air velocity sensor and the fan. Therefore, the reserve flow generated by the fan is blocked by the straightening vane, and cannot move to the air velocity sensor side. For that reason, the flow is stable in the vicinity of the air velocity sensor without occurrence of the disturbance in a flow of fluid, and hence it is possible to accurately measure the air velocity.

According to the present invention, the intake port of the intake side flow path branch part is directed opposite to a flow direction of the sampling air that flows in the airflow pipe. For example, particles heavier than smoke particles, such as dust, are advanced downstream in the vicinity of the intake port due to an inertia force in a flow direction of the sampling air because the flow direction cannot be changed rapidly. For that reason, the dust or the like, sucked mixedly with the sampling air, which is sucked from the intake port is very small in amount, and hence it is possible to remarkably reduce the number of cleaning or exchanging of the filter as compared with that in the conventional art.

With the present invention being configured as described above, a part of the sampling air flowing in the airflow pipe is introduced into the smoke detection part due to a pressure difference occurring between the flow path branch part and the flow path merging part, and returns to the airflow pipe from the flow path merging part through the smoke detection part.

In this case, the sampling air exhausted from the smoke detection part through the exhaust pipe is merged through the flow path merging part having a nozzle part with an opening larger than the exhaust pipe, which sprays air that is substantially uniformly spread toward a vent hole lower in pressure than the flow path branch part of the fan.

Accordingly, the pressure loss of the flow at the branch part having the smoke detection part can be reduced, and hence the flow rate of the branch part flow can be increased. Further, the sampling air flow exhausted from the smoke detection part and the sampling air flow sucked by the fan can be stably merged.

DETAILED DESCRIPTION OF THE PREFERRED EMBODIMENTS

Figure 1:
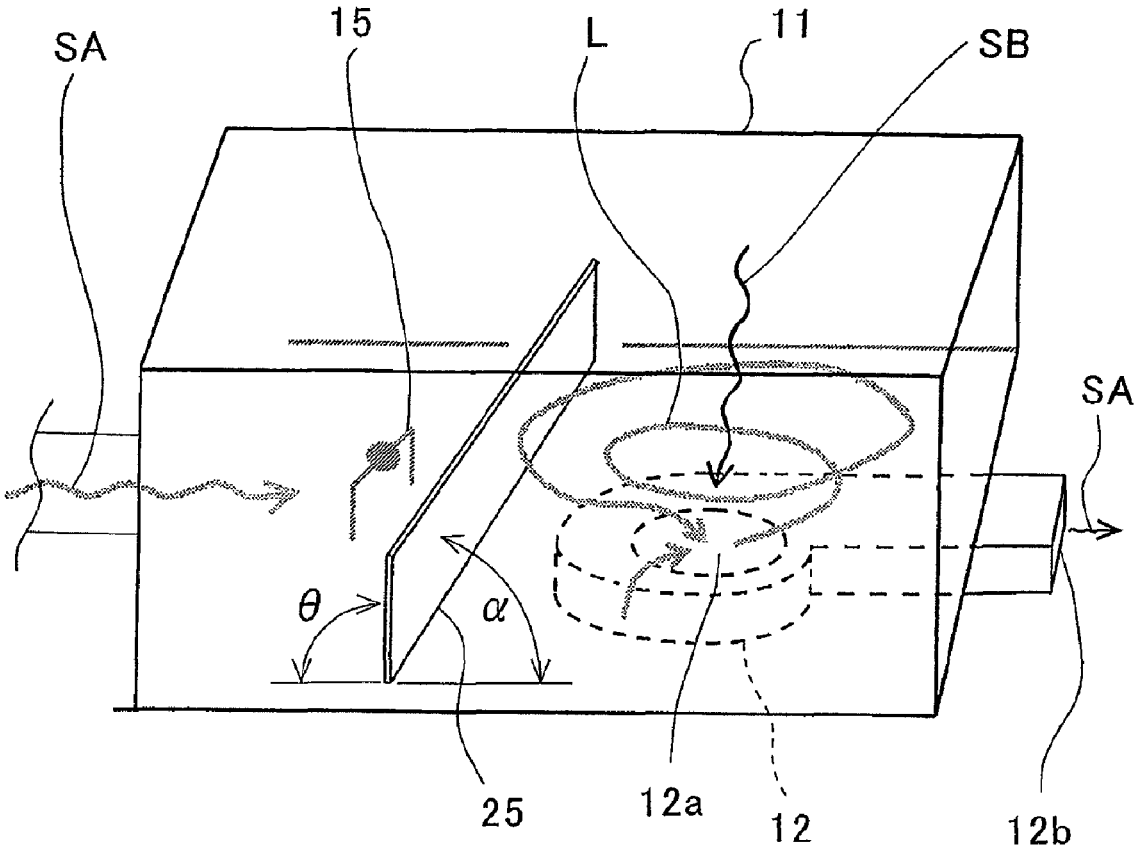
FIG. 1 is an enlarged perspective view illustrating a first embodiment of the first invention.

A first embodiment of the present invention is described with reference to FIGS. 1 and 2.

A smoke detector S includes a smoke detection part 22 connected to a sampling pipe 11 through a pipe 20, a filter 23 disposed at an inflow port 22*a* side of the smoke detection part 22, a fan (blower fan) 12 that sucks sampling air SA into the sampling pipe 11, and an air velocity sensor (flow sensor) 15 that measures an air velocity of the sampling air SA within the sampling pipe 11.

The smoke detection part 22 is provided with a light receiving element (smoke sensor) (not shown) such as a light emitting element and a photodiode, a light trap (not shown), a condenser lens (not shown), an aperture (not shown), and so on.

Within an inflow part 40 having a substantially box shape, and an intake port (not shown) for the sampling air arranged at a side surface thereof and a suction port 12*a* of the fan 12 arranged at a bottom surface thereof, an airflow direction of the sampling air SA at a primary side of the fan 12 is substantially orthogonal to an airflow direction SB caused by the suction port 12*a* of the fan 12. A straightening vane 25 is disposed between the primary side (upstream side) of the fan 12 and the air velocity sensor 15. The straightening vane 25 is formed into a substantially rectangular configuration (for example, about 50 mm in width and about 10 mm in height), and disposed at an angle $\alpha$ (for example, about 90°) to the bottom surface, and an angle $\theta$ (for example, about 90°) to the airflow direction of the sampling air SA. The inventor of the present invention has conducted comparative experiments between a case in which the straightening vane 25 is disposed within the inflow part 40 as illustrated in FIG. 1, and a case in which the straightening vane 25 is not disposed. Then, the inventor of the present invention has confirmed that, when the straightening vane 25 is arranged, outputs of the air velocity sensor 15 have a proportional relationship from a low air volume to a high air volume. That is, the straightening vane 25 is means for preventing a reverse flow L occurring due to a reduction in the air volume sucked by the fan 12 from moving to the air velocity sensor 15 side. The angles $\alpha$ and $\theta$ of the straightening vane 25 are set to be within a range of about 45 to 90° according to the fan 12 in order to prevent the reverse flow from the suction port 12*a* of the fan 12 from affecting the flow velocity measurement.

The configuration of the straightening vane 25 may be square or triangle other than substantially rectangle, and its size or the like is appropriately selected in a range where the function thereof can be exerted.

Further, the straightening vane 25 may be disposed on, for example, a ceiling surface or the like other than the bottom surface, and also the straightening vanes 25 may be disposed at a plurality of locations on both of the bottom surface and the ceiling surface. Further, the air velocity sensor 15 and the suction port 12*a* can be arranged immediately close to both sides of the straightening vane 25 (for example, about 30 mm or lower), and hence the inflow part 40 can be sufficiently downsized.

Next, the operation of the first embodiment is described.

When the fan 12 is driven, air in a monitor space is sucked into the sampling pipe 11, and the sampling air SA flows in the sampling pipe 11.

In this situation, after the air velocity thereof is measured by the air velocity sensor 15, the sampling air SA enters the fan 12 from the suction port 12*a*, and is exhausted from an exhaust port 12*b* while circling. A part of the sampling air SA passes through the pipe 20 and the filter 23, and enters the smoke detection part 22. Then, after smoke detection is executed by the smoke sensor (not shown) in the smoke detection part 22, the sampling air SA is returned to the sampling pipe 11.

When the suction air volume is small (at the time of the low air velocity), the reverse flow L occurs because the airflow in the pipe at the primary side of the fan 12 is disturbed by rotation of rotor blades within the fan 12. The reverse flow L is going to spread toward the upstream side within the sampling pipe 11, but collides with the straightening vane 25 because the straightening vane 25 is disposed on the upstream side. For that reason, the reverse flow L cannot reach the vicinity of the air velocity sensor 15, and hence no disturbance of the fluid flow occurs in the vicinity of the air velocity sensor 15, and the flow becomes stable, thereby enabling the air velocity to be precisely detected. Accordingly, the fan 12 controlled on the basis of the measurement value of the air velocity sensor 15 can be precisely controlled, and hence the sampling air as designed can be stably supplied to the smoke detection part 22, thereby enabling smoke detection high in precision. Further, the air velocity sensor 15 and the suction port 12*a* can be disposed immediately close to the straightening vane 25, thereby enabling sufficient downsizing.

Figure 2:
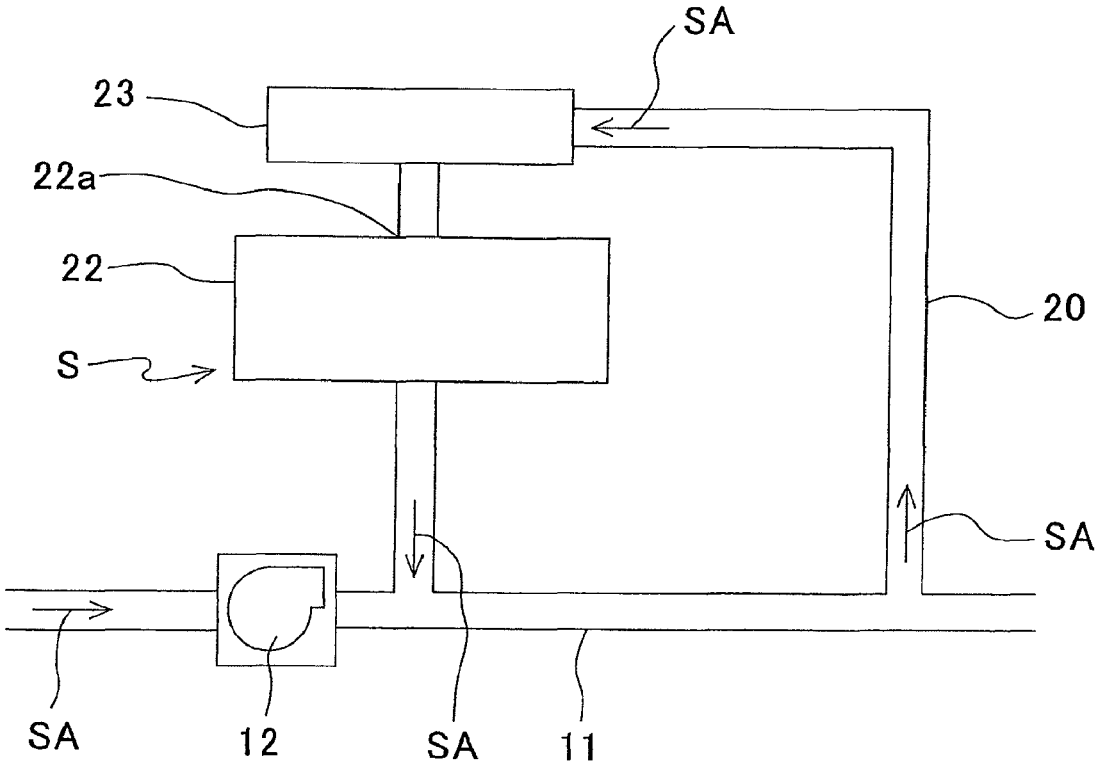
FIG. 2 is a configuration diagram illustrating the first embodiment of the first invention.
Figure 3:
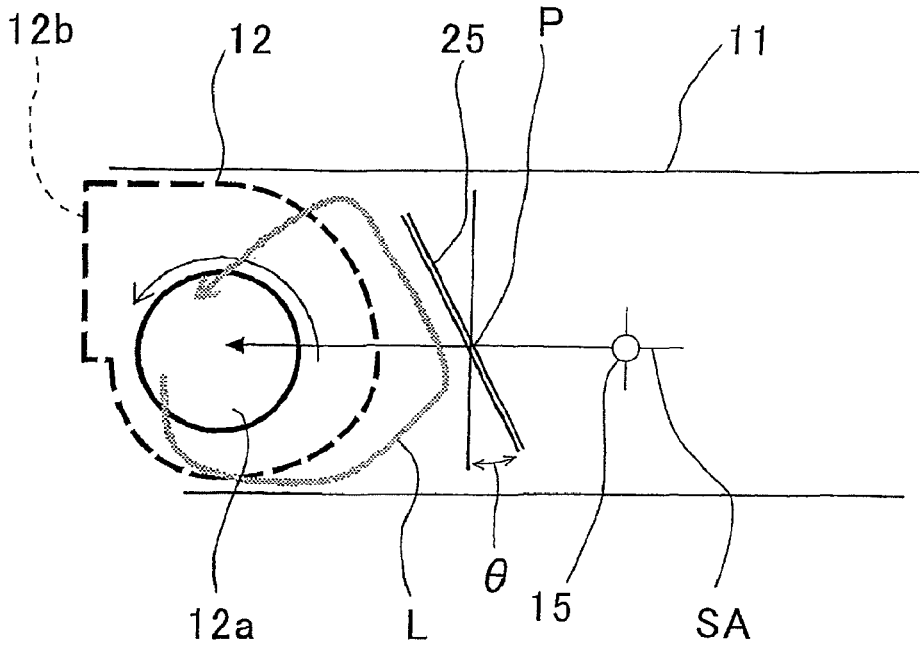
FIG. 3 is a plan view illustrating a second embodiment of the first invention.
Figure 4:
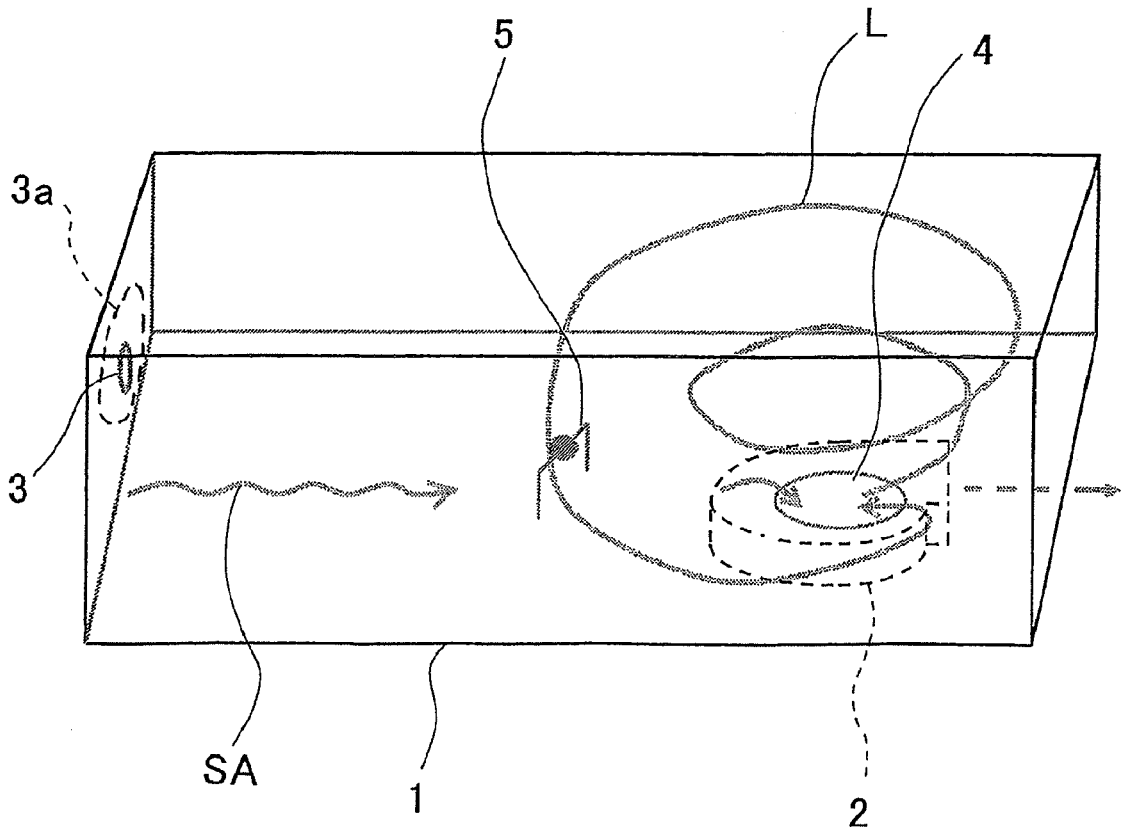
FIG. 4 is an enlarged perspective view illustrating a conventional example of the first invention.

A second embodiment of the present invention is described with reference to FIG. 3, and the same reference symbols of those of FIGS. 1 and 2 are also identical in the name and function.

A difference between the second embodiment and the first embodiment resides in that the straightening vane 25 is rotatably supported on the bottom surface or the ceiling surface of the inflow part 40 by a support shaft p. With the above-mentioned configuration, the straightening vane 25 can be set to the angle θ having the most shielding effect with respect to the reverse flow L according to the rotation speed of the fan 12 or the output of the air velocity sensor 15, and hence smoke detection with high precision can be executed even when the air velocity frequently varies.

A third embodiment according to the second invention is described with reference to FIGS. 5 and 6.

Figure 5:
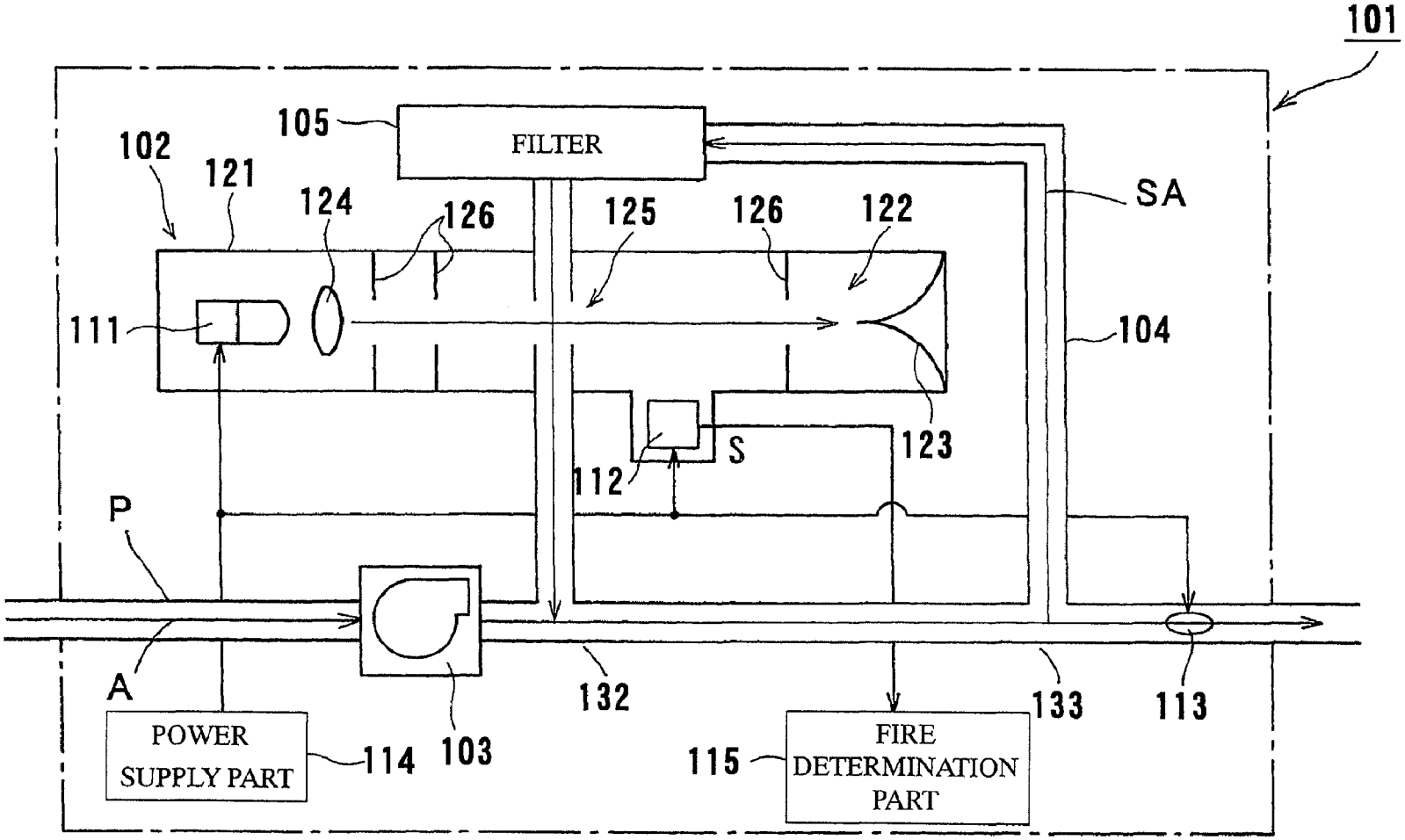
FIG. 5 is a plan view illustrating a third embodiment of the present invention.
Figure 6:
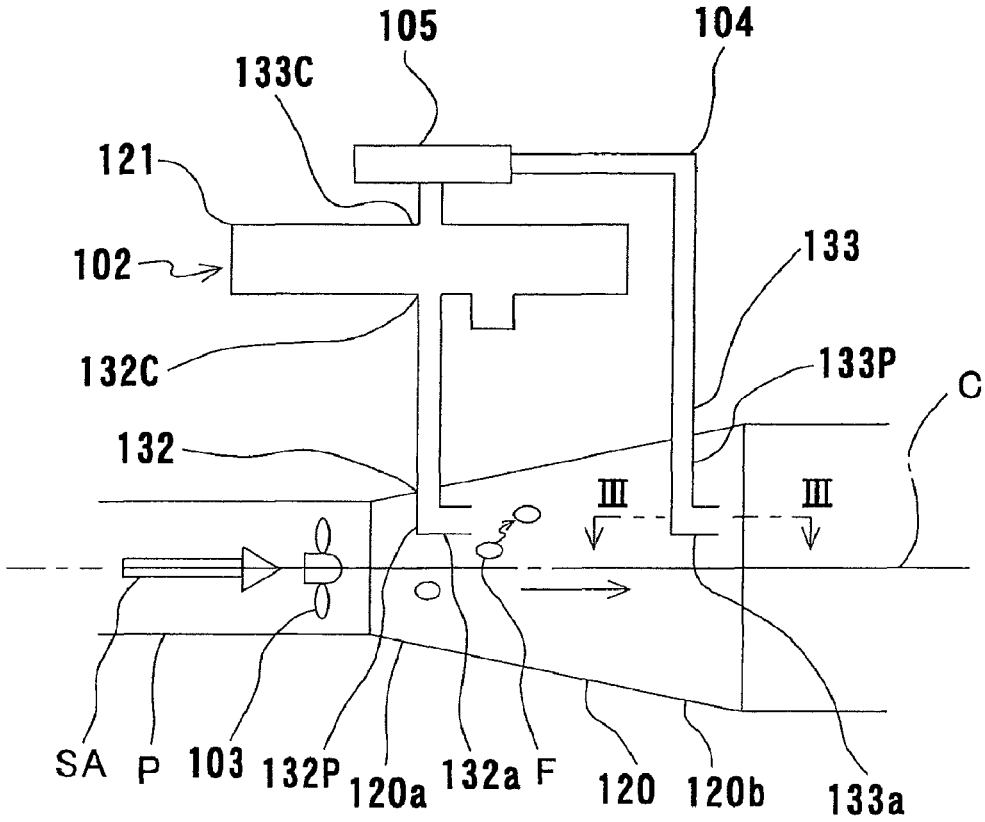
FIG. 6 is an enlarged cross-sectional view illustrating a main portion of FIG. 5.

As illustrated in FIG. 5, a smoke detector 101 includes a smoke detection unit 102 having a dark box 121, a fan 103 that feeds air (sampling air) SA to be detected to the smoke detection unit 102, a pipe 104 serving as an air passage, a light emitting element 111 disposed within the smoke detection unit 102, a light receiving element 112 such as a photodiode, an air flow sensor 113 that measures the flow rate of the air and the fan 103, a power supply part 114 that supplies a power to the air flow sensor 113, and a fire determination part 115 connected to the light receiving element 112.

A smoke detection part 125 is disposed in the center of the dark box 121 of the smoke detection unit 102, and the sampling air SA that has passed through the pipe 104 and filtered by the filter 105 is introduced into the smoke detection part 125. Reference numeral 123 denotes a light trap disposed in a light shielding part 122, reference numeral 124 denotes a condenser lens, and reference numeral 126 denotes an aperture.

The fire determination part 115 includes an amplifier circuit that amplifies an output signal S of the light receiving element 112, an A/D converter that converts a level of the amplifier circuit into a detection level, a comparator circuit that determines that fire occurs when the detection level becomes equal to or higher than a predetermined threshold value, and so on. The comprehensive control is executed by a CPU.

A diffuser part 120 is disposed at the secondary side of the fan 103 in an airflow pipe P. The diffuser part 120 spreads toward the downstream side. For example, the diffuser part 120 is of a divergent pipe (diffuser) forming substantially a cone such as a circular cone, an exhaust side flow path merging part 132 is disposed at a base end part 120*a* side, and an intake side flow path branch part 133 is disposed at a leading end part 120*b* side.

An intake port 133*a* of the intake side flow path branch part 133 is formed at the leading end part of a projection pipe 133P bent in an L-shape, and the leading end part of the projection pipe 133*p* is reserve to a flow direction C of the sampling air SA flowing in the airflow pipe P (is directed downstream). Further, an exhaust port 132*a* of the exhaust side flow path merging part 132 is formed at a leading end part of a projection pipe 132P bent in an L-shape, and the leading end part of the projection pipe 132*p* is directed opposite to the flow direction C of the sampling air SA flowing in the airflow pipe P (is directed downstream). Accordingly, the intake port 133*a* and the exhaust port 132*a* are directed in the same direction.

At the secondary side of the fan 103, the dark box 121 of the smoke detection unit 102 is provided, and an inflow port 133*c* of the smoke detection part 125 in the dark box 121 is connected to the intake port 133*a* of the intake side flow path branch part 133 through the filter 105, and an outflow port 132*c* thereof is connected to the exhaust port 132*a* of the exhaust side flow path merging part 132.

Next, the operation of a third embodiment is described.

When the fan 103 is driven, air A in the monitor space is sucked into the airflow pipe P through the sampling pipe (not shown), and then exhausted through the diffuser part 120. However, in this situation, the flow velocity in the exhaust side flow path merging part 132 within the diffuser part 120 is different from the flow velocity in the intake side flow path branch part 133 thereof, and thus a pressure difference between both of those parts occurs.

Due to the occurrence of the pressure difference, smoke particles contained in the sampling air SA flowing in the diffuser part 120 are sucked from the intake port 133*a* of the intake side flow path branch part 133, and pass through the filter 105 and enter the inflow port 133*c* of the smoke detection part 125. The smoke particles are then irradiated with a laser beam of the light emitting element 111 and advance within the smoke detection part 125 while generating a scattered light, pass through the exhaust port 132*a* of the exhaust side flow path merging part 132 from the outflow port 132*c*, and are returned to the interior of the diffuser part 120.

Powder dust or the like F is contained in the sampling air SA flowing in the airflow pipe P, but the powder dust or the like F is heavier than the smoke particles, and hence the powder dust or the like F flows down with a large inertia force in a current direction. For that reason, the powder dust or the like F advances downstream within the airflow pipe 4, unlike the light smoke particles mixed with the sampling air SA sucked into the intake port 133*a*, and hence the sampling air SA that is not or hardly mixed with the powder dust or the like F can be introduced from the intake port 133*a*. Accordingly, the powder dust or the like F deposited on the filter 105 is remarkably reduced as compared with the conventional example, and hence it is possible to reduce the number of cleaning or exchanging the filter.

Figure 7:
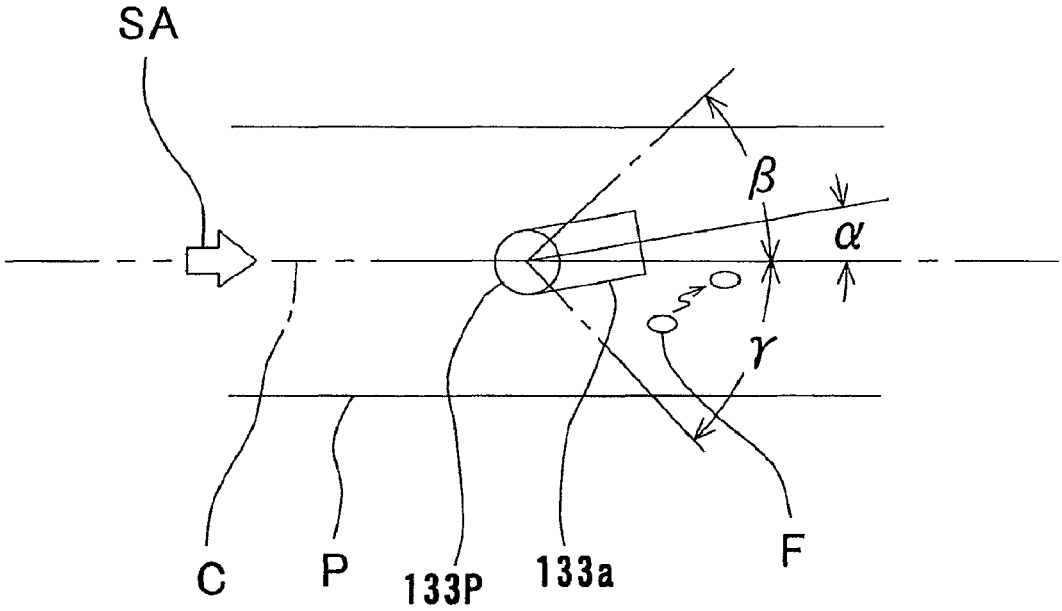
FIG. 7 is a cross-sectional view of an intake side flow path branch part 133 taken along a line III-III.

FIG. 7 is a cross-sectional view of the intake side flow path branch part 133 taken along a line III-III.

The projection pipe P of the intake side flow path branch part 133 is formed in an L-shape, and the intake port 133*a* disposed at the leading end part thereof is directed downstream. The leading end part is not exactly opposite to the flow direction C of the sampling air SA (identical in axial center with the flow direction C), but is inclined by an angle α, for example, 10°. The angle α is a foreign matter entrance prevention angle which is capable of preventing the foreign matter such as the powder dust or the like F from being mixed together, and is appropriately selected within a range of angles β and γ, for example, a range of 0 (identical with the above-mentioned direction C) to 45°.

Figure 8:
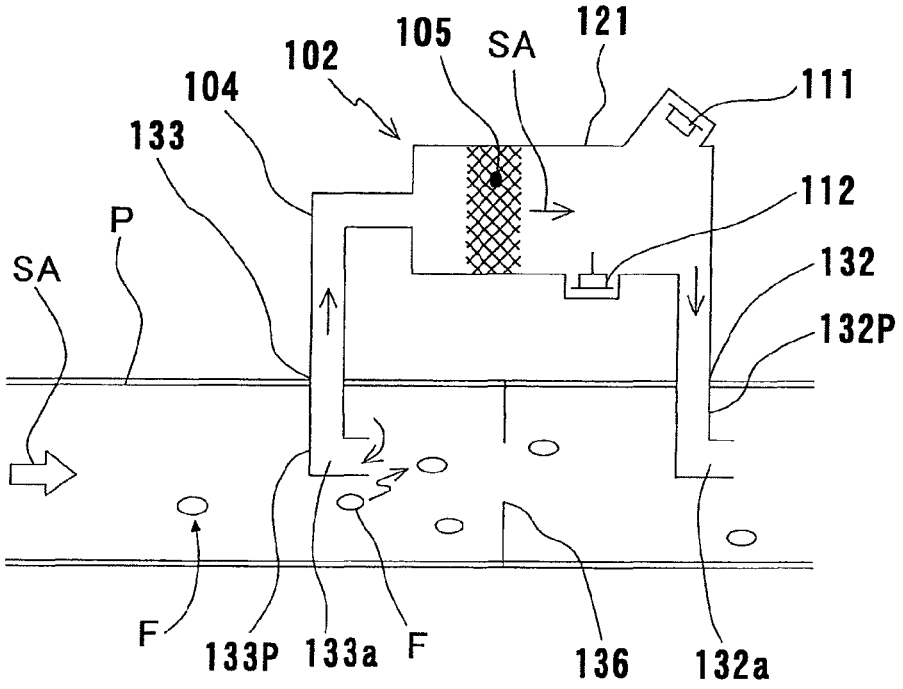
FIG. 8 is a front enlarged cross-sectional view illustrating a fourth embodiment of the present invention and corresponding to FIG. 6.

A fourth embodiment of the second invention is described with reference to FIG. 8. The same reference symbols as those of FIGS. 6 and 7 are also identical in name and function.

Differences between the fourth embodiment and the third embodiment are stated below.

(1) As pressure difference generating means, the diffuser part 120 is replaced with an orifice 136. The orifice 136 is disposed between the intake side flow path branch part 133 and the exhaust side flow path merging path 132 of the airflow pipe P.

(2) The intake side flow path branch part 133 is disposed not downstream of the exhaust side flow path merging path 132, but upstream thereof.

In the fourth embodiment, it is difficult to change the flow direction of the powder dust or the like F from the main flow to the opposite direction due to the inertia force thereof. For that reason, the mixture of the powder dust or the like F into the intake port 133*a* is reduced, and hence the filter lifetime can be extended as compared with the conventional example, and false detection of the fire determination part due to the powder dust or the like F is also reduced.

A fifth embodiment of the third invention is described with reference to the drawings on the basis of an example.

Figure 9:
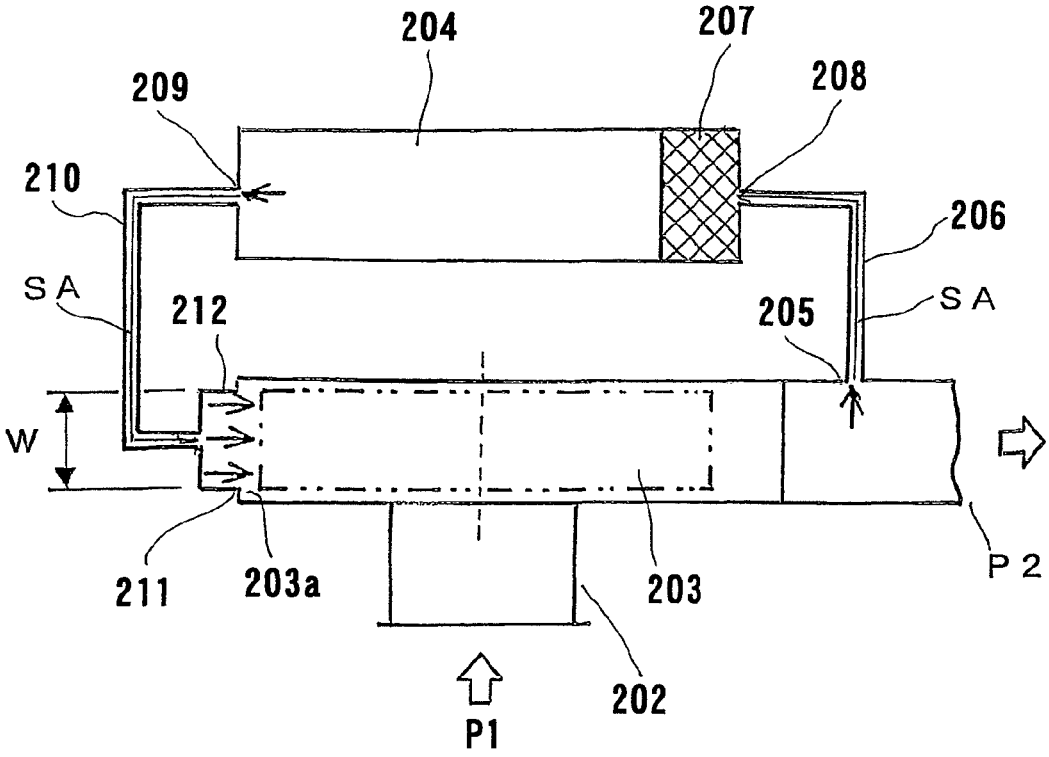
FIG. 9 is an explanatory diagram illustrating a main portion of a smoke detector according to the present invention.

FIG. 9 illustrates a smoke detector according to the example of the present invention, in which a smoke detector 201 is designed such that an airflow pipe 202 is connected to a sampling pipe arranged in a monitor space (not shown), a fan 203 (for example, blower fan) that sucks and exhausts contaminated air in the monitor space as the sampling air A is disposed to the upstream part (primary side) of the airflow pipe 202, and a flow path branch part 205 that allows a part of the sampling air A exhausted from the fan 203, that is, the sampling air SA to be detected, to flow into the smoke detection part 204 is formed in the downstream part (secondary side) of the airflow pipe 202.

The flow path branch part 205 is connected with a sampling air inflow pipe 206 that circulates the sampling air SA to be detected, and one end of the sampling air inflow pipe 206 is connected to an inflow port 208 of a smoke detection part 204 for the sampling air SA, which includes a filter 207 and a smoke detection unit made up of optical smoke detecting means having a light emitting element (not shown) and a light receiving element (not shown), air flow rate measuring means, and so on.

On the other hand, an outflow port 209 of the smoke detection part 204 for the sampling air SA is connected with one end of a sampling air exhaust pipe 210, and a flow path merging part at another end of the sampling air exhaust pipe 210 (for the sampling air which has passed through the smoke detection part 204) is connected to a vent hole 203*a* that is lower in pressure than the flow path branch part immediately close to the peripheral edge of the rotor blades of the fan 203.

A flow path merging part 211 includes the vent hole 203*a* of the fan 203 which has an opening larger than that of the sampling air exhaust pipe 210, and a nozzle 212 having one end connected to the sampling air exhaust pipe 210, and another end with substantially the same opening as that of the vent hole 203*a* of the fan 203 and capable of spraying the sampling air SA with a flow that substantially uniformly spreads toward the vent hole 203*a* of the fan 203.

With the above-mentioned configuration, it is possible to reduce the pressure loss of a flow in the branch part including the smoke detection part 204, and to stably merge together the sampling air flow exhausted from the smoke detection part 204 and the sampling air flow of the airflow pipe 202, which is sucked by the fan 203.

Figure 10:
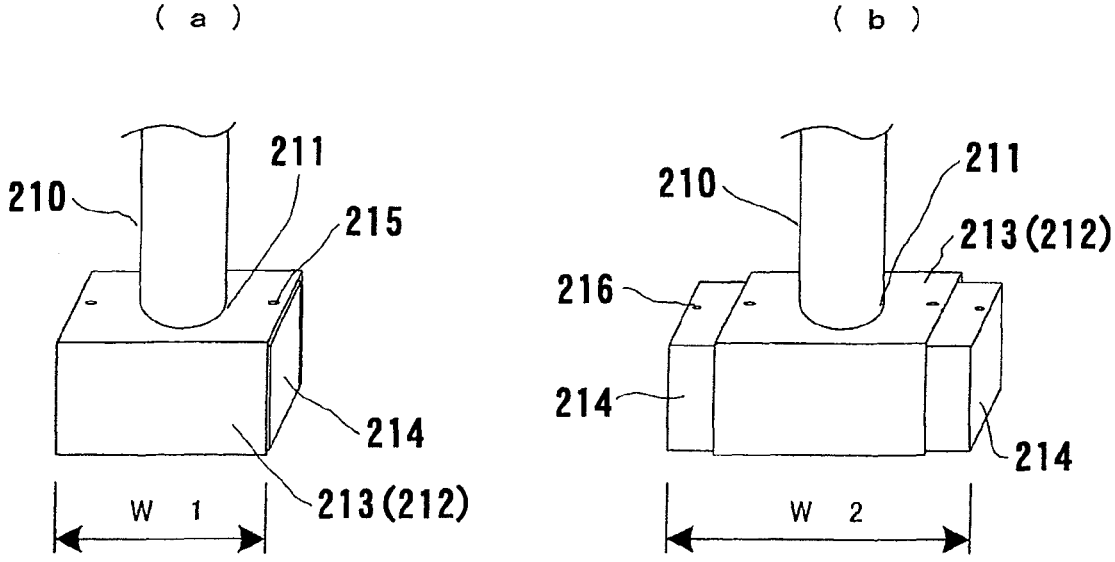
FIG. 10A is a perspective view illustrating a nozzle used in the present invention.
FIG. 10B is a perspective view of an extended nozzle of FIG. 10A.

Further, an example of the nozzle 212 is described with reference to FIGS. 10A and 10B. At an opening end forming the flow path merging part 211 disposed at the another end of the sampling air exhaust pipe 210 (for the sampling air which has passed through the smoke detection part 204) is disposed an outer cylinder 213 having substantially the same opening W1 as the opening diameter of the vent hole 203*a* of the fan 203. The outer cylinder 213 is configured to be extendable as illustrated in FIG. 10B, whereby the size of the injection port of the nozzle 212 can be adjusted to an opening W2 larger than the opening of the vent hole 203*a* of the fan 203.

In order to supply a stable and substantially uniform flow to the vent hole 203*a*, the leading end of the nozzle 212 may be configured to be gradually spread.

In this example, an inner cylinder 214 extendable laterally may be incorporated into the outer cylinder 213, and a clamp 215 such as a rivet is inserted into a clamp hole 216, thereby making it possible to provide a given width for the opening W1 or W2.

The extendable nozzle is not limited to the above-mentioned example.

In FIG. 9, reference symbol P1 denotes an air inflow port, and reference symbol P2 denotes an air exhaust port.

What is claimed is:

1. A smoke detector, comprising:

a smoke detection part having an inflow port and an outflow port;

an airflow pipe coupled with a sampling pipe disposed in a monitor space, in which a fan intervenes;

a flow path branch part coupled with an inflow port of the smoke detection part; and a flow path merging part disposed in the airflow pipe and coupled with the outflow port of the smoke detection part through an exhaust pipe, wherein the flow path merging part is equipped with a nozzle part having an opening larger than the exhaust pipe, which sprays air toward a vent hole lower in pressure than the flow path branch part of the fan.

2. A smoke detector according to claim 1, wherein the opening of the nozzle part is adjustable.

* * * * *